US007237484B2

(12) United States Patent
Weschenfelder et al.

(10) Patent No.: US 7,237,484 B2
(45) Date of Patent: Jul. 3, 2007

(54) DEVICE AND METHOD FOR PRESSING A DRESSING ON A CYLINDER OF A PRINTING MACHINE

(75) Inventors: Kurt Johannes Weschenfelder, Zell/Main (DE); Karl Robert Schäfer, Rimpar (DE); Georg Schneider, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 170 days.

(21) Appl. No.: 10/524,878

(22) PCT Filed: Aug. 7, 2003

(86) PCT No.: PCT/DE03/02650

§ 371 (c)(1),
(2), (4) Date: Feb. 17, 2005

(87) PCT Pub. No.: WO2004/020205

PCT Pub. Date: Mar. 11, 2004

(65) Prior Publication Data

US 2006/0162598 A1 Jul. 27, 2006

(30) Foreign Application Priority Data

Aug. 21, 2002 (DE) ..... 102 38 177

(51) Int. Cl.
*B41F 27/12* (2006.01)

(52) U.S. Cl. ..... 101/477; 101/415.1

(58) Field of Classification Search ..... 101/477, 101/415.1, 378, 382.1, 216, 217
See application file for complete search history.

(56) References Cited

U.S. PATENT DOCUMENTS

| | | | | |
|---|---|---|---|---|
| 4,727,807 | A | 3/1988 | Suzuki et al. | |
| 5,406,888 | A | 4/1995 | Sugiyama et al. | |
| 5,617,792 | A | 4/1997 | Rau et al. | |
| 5,738,015 | A * | 4/1998 | Kusch et al. | 101/477 |
| 5,806,431 | A | 9/1998 | Muth | |
| 6,199,280 | B1 | 3/2001 | Schneider et al. | |
| 6,439,117 | B1 | 8/2002 | Dumais et al. | |
| 6,792,860 | B2 | 9/2004 | Schroder et al. | |
| 2004/0050276 | A1 | 3/2004 | Schafer | |
| 2004/0244615 | A1 * | 12/2004 | Herbert et al. | 101/227 |

FOREIGN PATENT DOCUMENTS

| | | |
|---|---|---|
| DE | 196 20 997 C2 | 5/1996 |
| DE | 196 39 800 C1 | 2/1998 |
| DE | 197 19 559 A1 | 11/1998 |
| DE | 101 20 134 A1 | 11/2001 |

(Continued)

*Primary Examiner*—Leslie J. Evanisko
(74) *Attorney, Agent, or Firm*—Jones, Tullar & Cooper P.C.

(57) ABSTRACT

A dressing is pressed onto a surface of a cylinder of a printing machine by the use of at least two pressing elements. These two pressing elements are separated from each other in a circumferential direction of the cylinder. A portion of each of the two pressing elements can be moved toward or away form the surface of the cylinder independently of each other. The pressing elements are preferably arranged on supports that are connected to each other. Each of the pressing elements is provided with its own independent actuator.

17 Claims, 8 Drawing Sheets

FOREIGN PATENT DOCUMENTS

| | | | |
|---|---|---|---|
| DE | 100 58 996 | C1 | 6/2002 |
| DE | 101 58 158 | A1 | 6/2003 |
| EP | 0 712 725 | A2 | 5/1996 |
| WO | WO 01/87613 | A1 | 11/2001 |
| WO | WO 3031179 | A2 * | 4/2003 |

* cited by examiner

DEVICE AND METHOD FOR PRESSING A DRESSING ON A CYLINDER OF A PRINTING MACHINE

CROSS-REFERENCE TO RELATED APPLICATIONS

This U.S. patent application is the U.S. national phase under 35 USC 371, of PCT/DE2003/002650, filed Aug. 7, 2003, published as WO 2004/020205 A2 and A3 on Mar. 11, 2004 and claiming priority to DE 102 38 177.1, filed Aug. 21, 2002, the disclosures of which are expressly incorporated herein by reference.

FIELD OF THE INVENTION

The present invention is directed to devices for pressing a dressing against a cylinder of a printing press with the aid of first and second rolling elements, which rolling elements are spaced apart from each other in a circumferential direction of the cylinder, and to a method for tightening or bracing, or slackening or removing such a dressing.

A device for use in pressing a dressing against a cylinder of a printing press, with the aid of several rolling elements, in particular with the aid of several rollers arranged along the cylinder, is known from EP 0 712 725 A2.

WO 01/87613 A1 describes a method and several embodiments of a device for pressing a dressing against a cylinder of a printing press. Several rollers are pressed against the cylinder by an actuating assembly during mounting and dismounting of a dressing. The actuating assembly can be configured as a reversibly deformable hollow body, such as, for example a tube, which can be charged with a pressure medium. By charging the hollow body with the pressure medium, a rigid roller support, which is embodied substantially in the form of a die, is pressed against the cylinder, against the force of a spring. In one preferred embodiment, the roller support is embodied either as a rocker or as a one-armed lever. In addition to the first rollers, which are spaced apart from each other and which can be placed against the cylinder for mounting fresh or new dressings, another preferred embodiment of this prior device provides a plurality of second rollers, which second rollers can be placed against the cylinder for use in dismounting dressings. Two actuating assemblies, which can be operated independently of each other, can be provided for placing the first and second rollers against the cylinder.

A device for use in pressing a dressing against a cylinder of a printing press, with the aid of first and second rolling elements which are arranged one behind the other in the circumferential direction of the cylinder, is known from DE 196 39 800 C1. The first and second rolling elements can only be placed against or moved away from the cylinder together in this prior device.

A device for use in mounting flexible printing plates is known from DE 197 19 559 A1. A pressure roller is arranged on a holder which is embodied, for example, as a leaf spring. The holder is connected with an insertion slider. The insertion slider can be placed against a forme cylinder by a linear movement and, in the process, introduces an end of the printing plate into a fastening slit cut into the forme cylinder.

A device for use in accomplishing the automatic feeding of printing plates to a cylinder is known from U.S. Pat. No. 5,406,888. Two rolling elements, arranged one behind the other in the circumferential direction of the cylinder, are arranged on a rigid lever which can be jointly pivoted against the cylinder. One of the two rolling elements is arranged at the pivot point of the lever.

A manipulating device for use in automatically mounting or dismounting printing plates on a cylinder is known from U.S. Pat. No. 4,727,807. A gripper of the manipulating device has two rolling elements which are arranged one behind the other, in the cylinder circumferential direction, in a common frame.

SUMMARY OF THE INVENTION

The object of the present invention is directed to providing devices for use in pressing a dressing on a cylinder of a printing press with the aid of first and second rolling elements, which first and second rolling elements are spaced apart from each other in the circumferential direction of the cylinder, and to a method for tightening or bracing or for slackening or removing such a dressing.

In accordance with the present invention, this object is attained by the provision of several first or leading pressing elements, and several second or trailing pressing elements all positioned adjacent the circumferential surface of a cylinder on which several dressings are positioned side-by-side in an axial direction of that cylinder. If desired, a partial number of the first pressing elements, and a partial number of the second pressing elements can be placed against, or moved away from the cylinder independently of remaining ones of the first or second pressing elements. In one operating position, all of the first pressing elements and only a partial number of the second pressing elements are placed against the cylinder.

The advantages to be gained by the present invention consist, in particular, in that the device can be constructed to be very flat, and therefore is configured in a space-saving manner, which is very advantageous because of the existing structural conditions of a printing press. A preferably layered arrangement of the supports for the dressing elements results in that the device can also be constructed in a very compact manner in the circumferential direction of the cylinder. In spite of the use of rolling elements, which are arranged one behind the other in the circumferential direction of the cylinder, the total of two lever arms placed in series is not required as the structural space. Such required structural space is only slightly more than the length of one lever arm.

Furthermore, the device in accordance with the present invention is resistant to dirt and is more rugged than an arrangement configured with supports attached to a hinge, for example. Such a hinge, at the intended installation location, must be protected against soiling, such as by ink splatters or dust, to facilitate its interference-free functioning, which protection entails an additional outlay.

The supports for the rolling elements in the present invention are configured as an elastically bendable body. In the course of interaction, with the actuating device acting on the support, no separate spring element is required for use in returning the supports into their initial position after an operation of the actuating device. This is because the support has an inherent spring-back property.

In addition to the fact that by the use of the arrangement of the supports and rolling elements, in accordance with the present invention, that a very flat structural shape is achieved, other functional advantages arise from the tandem arrangement of the rolling elements. Thus, dressings resting on the surface area of the cylinder can remain fixed in place as needed by use of the first rolling element, although the second rolling element also releases an end of a dressing or ends of several dressings, i.e. does not press them on at this time. If, with respect to a particular dressing, the first and the second rolling elements are placed against the cylinder, advantageous friction values and guide conditions result for delivering and transporting this dressing.

A further advantage of the device in accordance with the present invention is the easy accessibility of the actuating assembly for use in pressing dressings against a cylinder. This ease of accessibility is of particular importance if a large number of rolling elements, with their supports, are to be placed against, and moved away from the cylinder independently of each other.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENT

Figure 1:
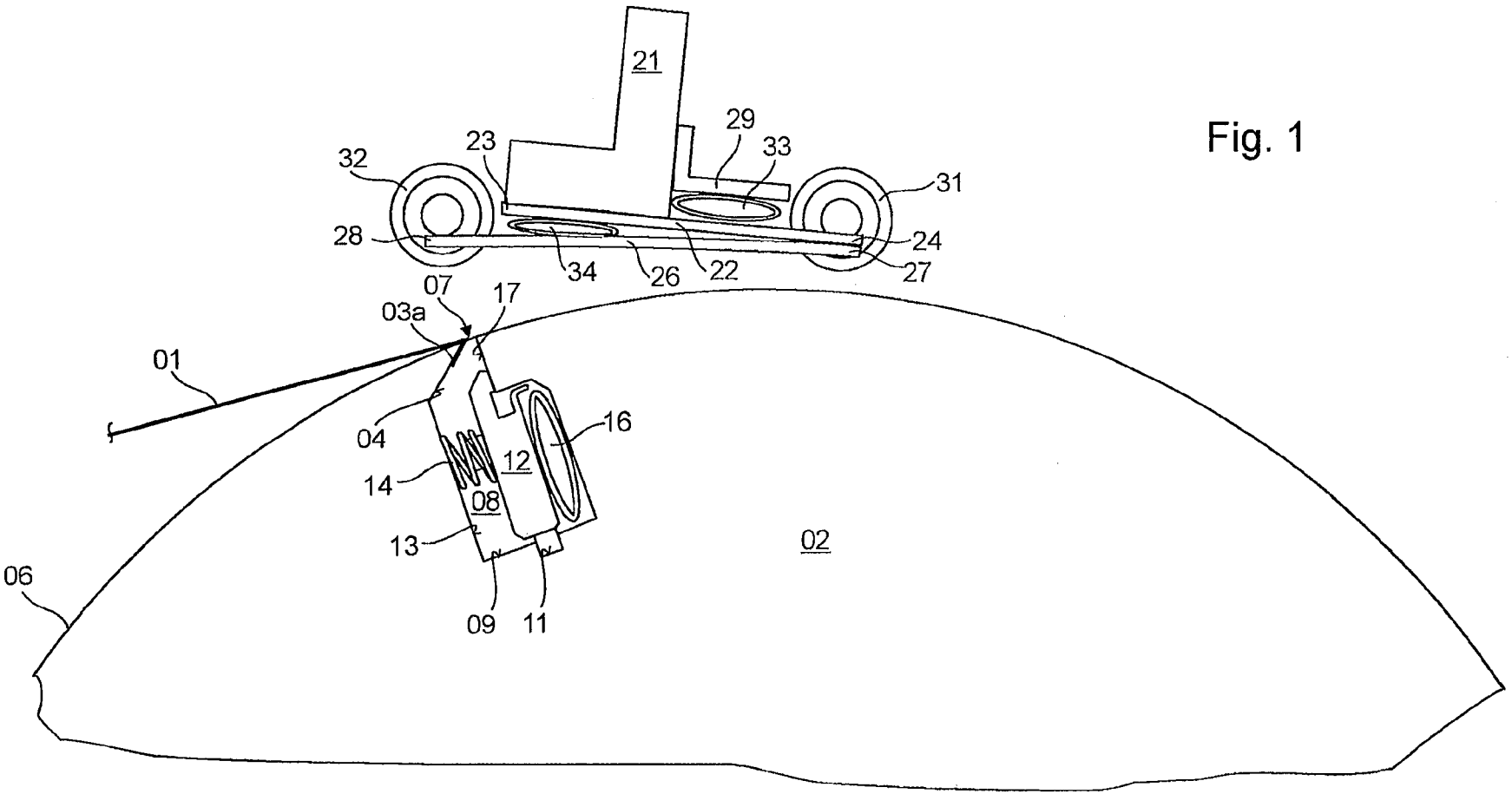
FIG. 1, a schematic depiction of a side elevation view of a device for pressing a dressing against a cylinder of a printing press with the aid of rolling elements in accordance with the present invention, in FIG. 2 to FIG. 4, schematic side elevation views showing the progression of a method for bracing or tightening a flexible dressing on a cylinder of a printing press with the aid of rolling elements which are arranged on elastically bendable supports, all in accordance with the present invention, in FIGS. 5 and 6, schematic side elevation views and showing a method step utilized when releasing a flexible dressing from a cylinder of a printing press with the aid of rolling elements arranged on elastically bendable supports, in FIG. 7, a schematic depiction of one arrangement of an assignment of separate ones of rolling elements, arranged on second supports, to several dressings applied side-by-side on a cylinder while one of these dressings is being removed, all in accordance with the present invention, and in FIG. 8, a schematic depiction, in a perspective view, of a cylinder configured with the device for pressing dressings against the cylinder, the cylinder being configured to receive two dressings circumferentially and six dressings axially.

Referring initially primarily to FIG. 1, a dressing 01 is brought to a cylinder 02 of a printing press, for example to a cylinder 02 of a web-fed rotary offset printing press by suitable apparatus, which is not specifically shown. The dressing 01 can be, for example, a flexible dressing, and, in particular, can be an elastically flexible printing forme 01, which is to be placed on a forme cylinder 02. A suspension leg 03*a*, which is beveled or angled off at a leading end of the dressing 01, is suspended, and preferably is positively connected, to a cooperatively configured first wall 04 of a preferably slit-shaped opening 07 that is cut into or is otherwise provided in a surface area 06 of the cylinder 02. If the dressing 01 extends over the entire circumference of the cylinder 02, a single such opening 07, as depicted in FIG. 1, in the cylinder 02 may be sufficient. In a situation of several dressings 01, which are to be applied in the circumferential direction of the cylinder 02, as may be seen in FIG. 8, several, preferably identically configured openings 07 are located in the cylinder 02 in an arrangement where these several axially extending, essentially identical openings 07 are offset along the cylinder circumference. With two dressings 01 situated in the circumferential direction of cylinder 02, the two required openings 07 are arranged circumferentially offset by 180°, with respect to each other, for example. In this case of two dressings 01, a suspension leg 03*a* at the leading end of the one dressing 01 is fastened in the first opening 07, as seen in FIG. 1 while a suspension leg 03*b* at the trailing end of the same dressing 01 is fastened in the other opening 07, which is not specifically represented in FIG. 1. With a 6/2 printing press, the preferred arrangement of dressings consists of two dressings 01 in the circumferential direction of the cylinder 02, and six side-by-side arranged dressings 01 in the axial direction of the cylinder 02.

The opening 07 in the cylinder circumferential surface area 06 leads to a channel 08 that is extending axially along the cylinder 02, and in which channel 08 a plate end holding device, for example a clamping device, is located, which plate end holding device consists substantially of a holding member 12, that is pivotably seated in a groove 11 on the bottom 09 of the channel 08, as well as of a spring element 14 clamped between a wall 13 of the channel 08 and the holding member 12, as seen in FIG. 1. The holding member 12, which is advantageously embodied as a rigid lever, is pivotable, counter to, or against, the force of the spring element 14, by an actuating device 16 which is also supported in the channel 08 and which actuating device 16 is usable for releasing a clamped connection provided by the holding member 12 on the second wall 17 of the opening 07. Thus, the holding member 12 has a holding position as its operating position, which holding position, in particular, is a clamping position, and also has a release position. Such a clamping device is described, for example in DE 100 58 996 C1, and which corresponds to U.S. 2004/050276. For the purpose of explaining further details of the clamping device and its function, reference is expressly made to the above mentioned document, whose disclosure is expressly incorporated herein by reference.

A holder 21, such as, for example a cross arm 21, and which is extending along in the axial direction of cylinder 02, is provided in the vicinity of the cylinder 02 and is spaced at a distance from the cylinder 02. A device for use in pressing a dressing 01 against the cylinder 02 of the printing press, with the aid of pressing elements 31, 32, preferably rolling elements 31, 32, is arranged on the holder 21. These plural, spaced rolling elements 31, 32, as may be seen in FIG. 7, can be placed against the cylinder 02, or can be moved away from it. A first support 22 with a first support first end 23 and with a first support second end 24; and a second support 26, with a second support first end 27 and with a second support second end 28, are provided on holder 21. In one embodiment, the first end 23 of the first support 22 is fixedly connected with the cross arm or holder 21 that is extending axially along, and spaced from, the cylinder 02. At least one first rolling element 31 is arranged on the second end 24 of the first support 22. The first end 27 of the second support 26 is also connected with the first support 22, preferably with second end 24 of the first support 22, as seen in FIG. 1, and preferably in a fixed manner. The first support 22 and the second support 26 are substantially arranged layered one on top of the other. The first end 27 of the second support 26 preferably terminates flush with the second end 24 of the first support 22. At least one second rolling element 32 is arranged on the second end 28 of the second support 26. The first rolling element 31 and the second rolling element 32 are thus arranged spaced apart from each other, and are positioned one behind the other in the circumferential direction of the cylinder 02. As can be seen in all of the drawings, a so- called double-roller or tandem roller arrangement results. The term tandem roller arrangement in this context indicates that two substantially identical structural components, comprised here of the first and second pressing elements or rolling elements 31 and 32, respectively, are arranged one behind the other in the circumferential direction of the cylinder 02.

For use in placing the rolling elements 31, 32 against the cylinder 02 or for moving them away from it, a first actuation device 33, acting on the first element 22, and a second actuating device 34, acting on the second support 26, are provided. The first actuating device 33, and the second actuating device 34 can be actuated independently of each other. The achievement of such an independent placement of the rolling element 31, 32 against or away from the cylinder, by use of the independently operable actuating devices 33, 34 is of particular benefit when several dressings 01 have been arranged side-by-side in the axial direction on the cylinder 02, and it is intended to selectively clamp or to release these dressings 01 individually. During the removal of a single dressing 01, for example, the remaining dressings 01 can be securely maintained on the cylinder 02 by the use of rolling elements 31, 32 appropriately placed against them even if a common holding member 12 of a holding device, which holding member 12 is arranged for concurrently holding several dressings 01, is opened and thus releases the fastening of several of the dressings 01 situated on the cylinder 02.

The two actuating devices 33, 34 are each embodied, for example, in the form of a reversibly deformable hollow body, such as, for example a tube 33, 34, which tube 33, 34 can be charged with a pressure medium. For example, the first actuating device 33, acting on the first support 22, can be supported on a rigid stop 29, which is fixedly connected with the cross arm 21 or which has been formed on it, since the first actuating device 33, in particular, is arranged between the cross arm 21, or between the stop 29, and the first support 22. The second actuating device 34, acting on the second support 26, is preferably arranged between the first support 22 and the second support 26 and is preferably supported on the first end 23 of the first support 22, which first end 23 of first support 22 is connected with the cross arm 21. It is advantageous to embody the second support 26 to be longer than the first support 22. This results in an excess projection of second support 26 with such an excess projection being sufficient in length that the second rolling element 32, arranged on the second end 28 of the second support 26, can be positioned laterally with respect to the cross arm 21 during the non-actuated state of the second actuation device 34, and preferably without the second rolling element 32 touching the cross arm 21.

It is of particular advantage to embody each of the supports 22, 26 in the form of an elastically bendable, preferably reversibly deformable body, and in particular, in the shape of a blade, for example as a resilient sheet metal piece 22, 26. If, by operating an associated actuating devices 33, 34, an associated one of the supports 22, 26 can be elastically bent, for placing a rolling element 31, 32 against the cylinder 02, no additional devices are required for moving the rolling elements 31, 32 arranged on the supports 22, 26 away from the cylinder after an actuation of the associated actuating device 33, 34 has ceased. In this preferred embodiment, the supports 22, 26 each spring back into their original positions without the further imposition of forces acting from the outside.

The rolling elements 31, 32 can each be embodied as a rolling element 31, 32 or as a roller 31, 32. Several such first supports 22, each with at least one first rolling element 31, can be arranged side-by-side on the cross arm 21, in the axial direction of cylinder 02, wherein these first rolling elements 31 can each be placed against or can be moved away from the cylinder 02 independently of each other. Such movement of the several axially side-by-side arranged first rolling elements 31 can either be accomplished individually or in groups by the appropriate actuation of the first actuating device 33 assigned to each of the supports 22. In the same way, it can be advantageous to arrange several second supports 26, each with at least one second rolling element 32, side-by-side axially with respect to cylinder 02 on the first support 22. These second rolling elements 32 can be placed against or can be moved away from the cylinder 02 independently of each other also either individually or in groups by the appropriate actuation of the second actuating device 34 assigned to each of the supports 26. A preferred embodiment of the present invention provides that one first roller 31, extending axially along the cylinder 02, and that several second supports 26, each with at least one rolling element 32, are arranged on the first support 22. This embodiment becomes particularly useful in the case where the cylinder 02 has several dressings 01 located side-by-side on its cylinder surface area 06, and a second support 26, each with at least one second rolling element 32, is assigned to each dressing 01.

In accordance with a further preferred embodiment of the present invention, the device for pressing a dressing 01 against a cylinder 02 of a printing press can be configured in such a way that a plurality of dressings 01 can be arranged on the cylinder 02 side-by-side in the axial direction, wherein first and second pressing elements 31, 32, assigned to a first dressing 01, can be placed against, or can be moved away from a cylinder 02 independently of first and second pressing elements 31, 32 assigned to another dressing 01. This device is distinguished in that the first and second pressing elements 31, 32 are embodied as rolling elements, and in particular are embodied as rollers 31, 32. In this case, the first and second pressing elements 31, 32, or the first and second rolling elements 31, 32 can be placed against the cylinder 02 at least intermittently during its rotation. Or, the device for pressing a dressing 01 against a cylinder 02 of a printing press with the aid of rolling elements 31, 32 can have several first rolling elements 31, as well as several second rolling elements 32 located in the axial direction of the cylinder 02. The second rolling elements 32 are arranged spaced apart, in the circumferential direction of the cylinder 02, from the first rolling elements 31. This case is also distinguished in that individual ones of the second rolling elements 32, or groups of the second rolling elements 32, can be placed against the cylinder 02, or can be moved away from it, independently of individual ones or groups of first rolling elements 31. It is also possible to place all of the first rolling elements 31 against the cylinder. Selected ones of the second rolling elements 32 can be placed against or can be moved away from the cylinder 02.

From a review of the sequence of operation depicted in FIGS. 1 to 4, it is possible to understand a method for bracing or for tightening a flexible dressing 01 on a cylinder 02 of a printing press in accordance with the present invention, and with the aid of the first and second rolling elements 31, 32, which are arranged, spaced apart in the circumferential direction of the cylinder 02 and which are supported at ends of the supports 22, 26, which are preferably elastically bendable. The dressing 01 has suspension legs 03*a*, 03*b* beveled off its ends, and the cylinder 02 has an opening 07 cut into its surface area 06, which opening 07 has a first wall 04 and a second wall 17. The opening 07 leads to a channel 08 which is provided with a holding device including a holding member 12 arranged therein. Channel 08 is arranged extending axially in the cylinder 02. The holding member 12 of the holding device has a holding position and a release position as its operating positions. The method in accordance with the present invention is distinguished by the following method steps:

While the first and second rolling elements 31, 32 are all moved away from the surface area 06 of the cylinder 02, a suspension leg 03*a* located at the leading end of the dressing 01 is brought, preferably tangentially, against the surface area 06 of the cylinder 02 and is suspended on the first wall 04 of the opening 07 that is cut into the surface area 06 of the cylinder 02, as may be seen in FIG. 1.

Thereafter, the rolling elements 31, 32 are placed against the cylinder 02 by operating the actuating devices 33, 34, which actuating devices 33, 34 are acting on their respective supports 22, 26. This step of the method is depicted in FIG. 2.

Figure 3:
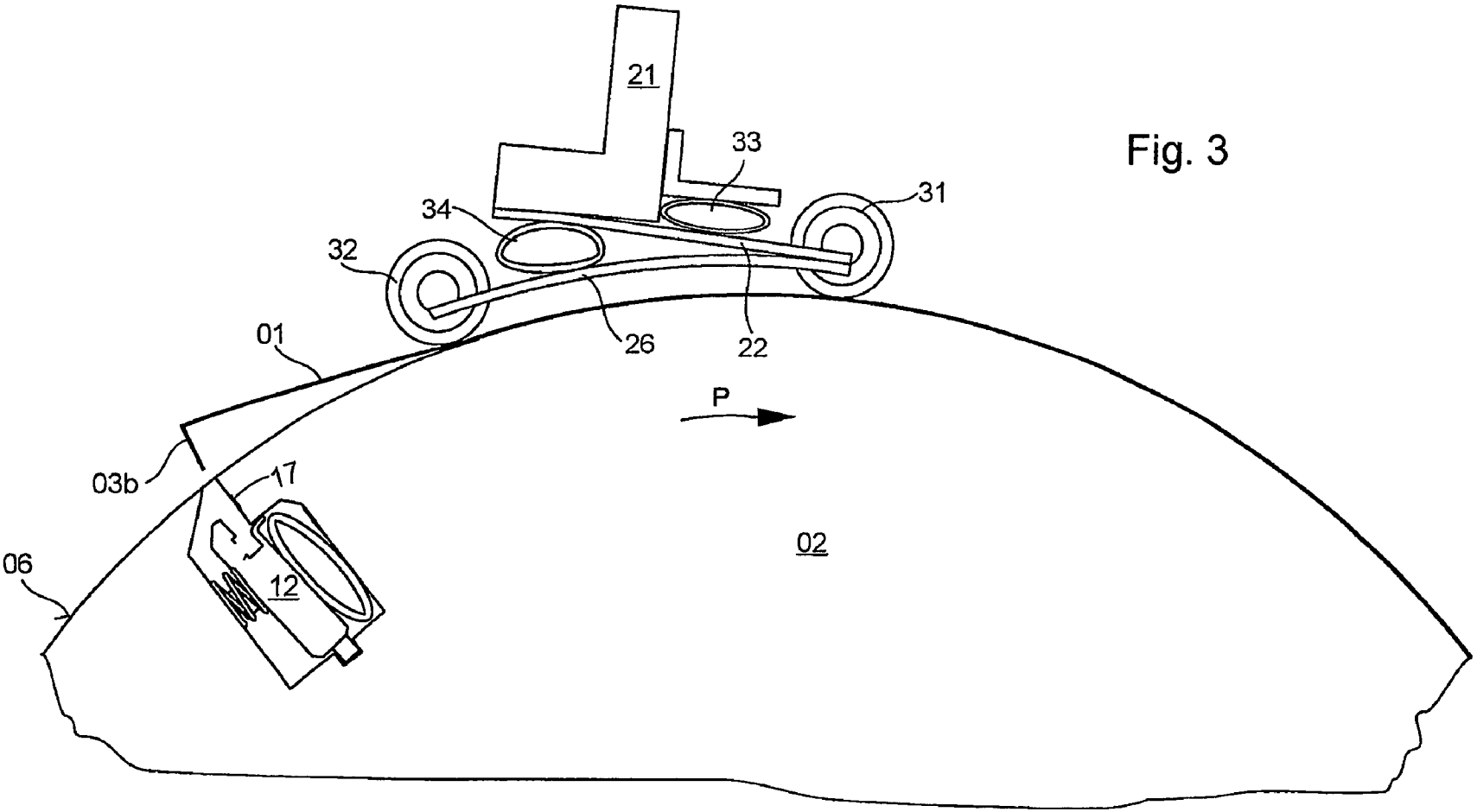
Figure 4:
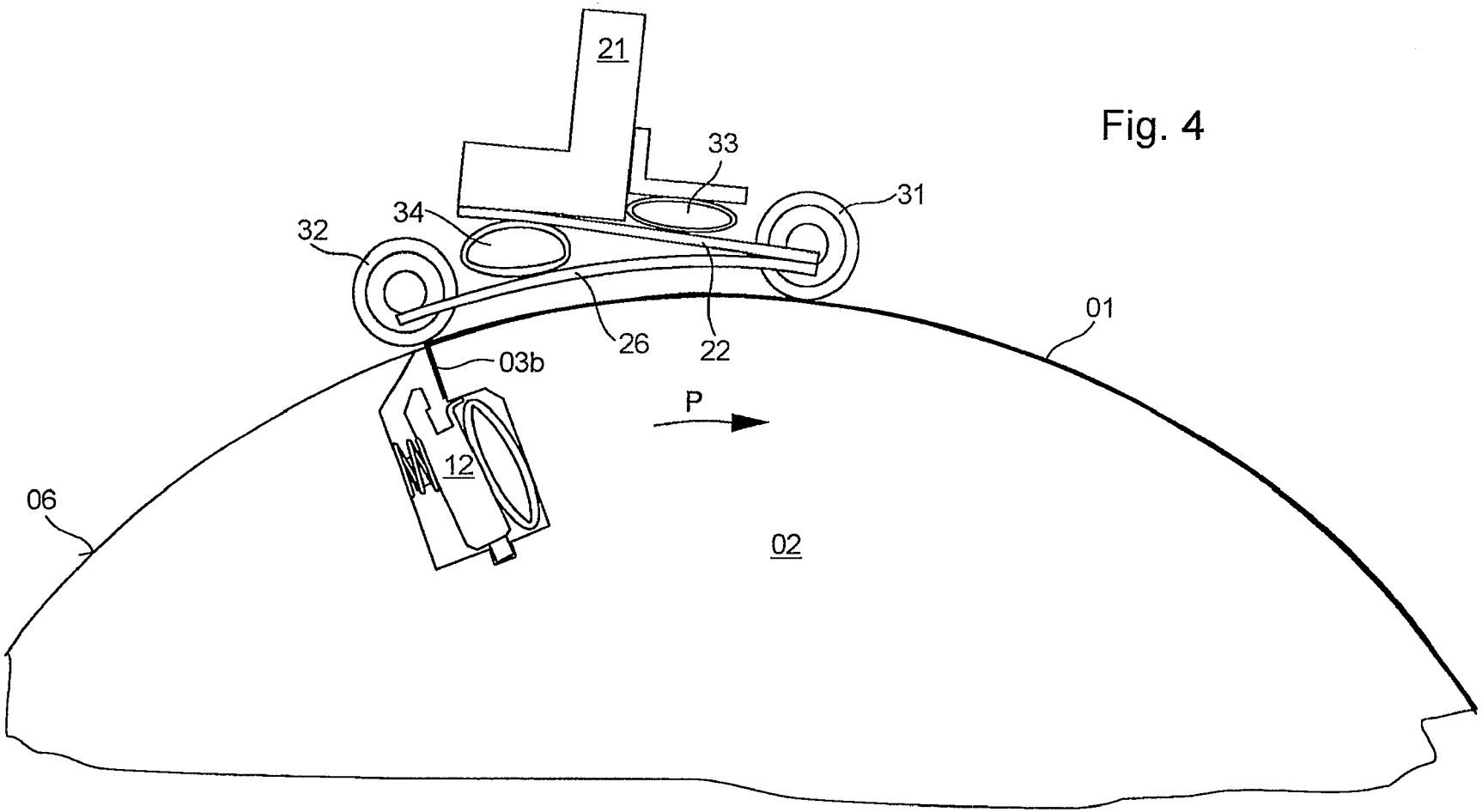

In the next step, as shown in FIG. 3 and also in FIG. 4, the cylinder 02 is rotated in the production direction P sufficiently far so that the suspension leg 03*b* on the trailing end of the dressing 01 rests on the second wall 17 of the cylinder opening 07, or on an identically embodied second wall 17 of a second cylinder opening 07, which second cylinder opening 07 is arranged on the circumference of the cylinder 02 and is offset circumferentially with respect to the first opening 07. The first and second rolling elements 31, 32 press the dressing 01 against the surface area 06 of the cylinder 02.

Figure 2:
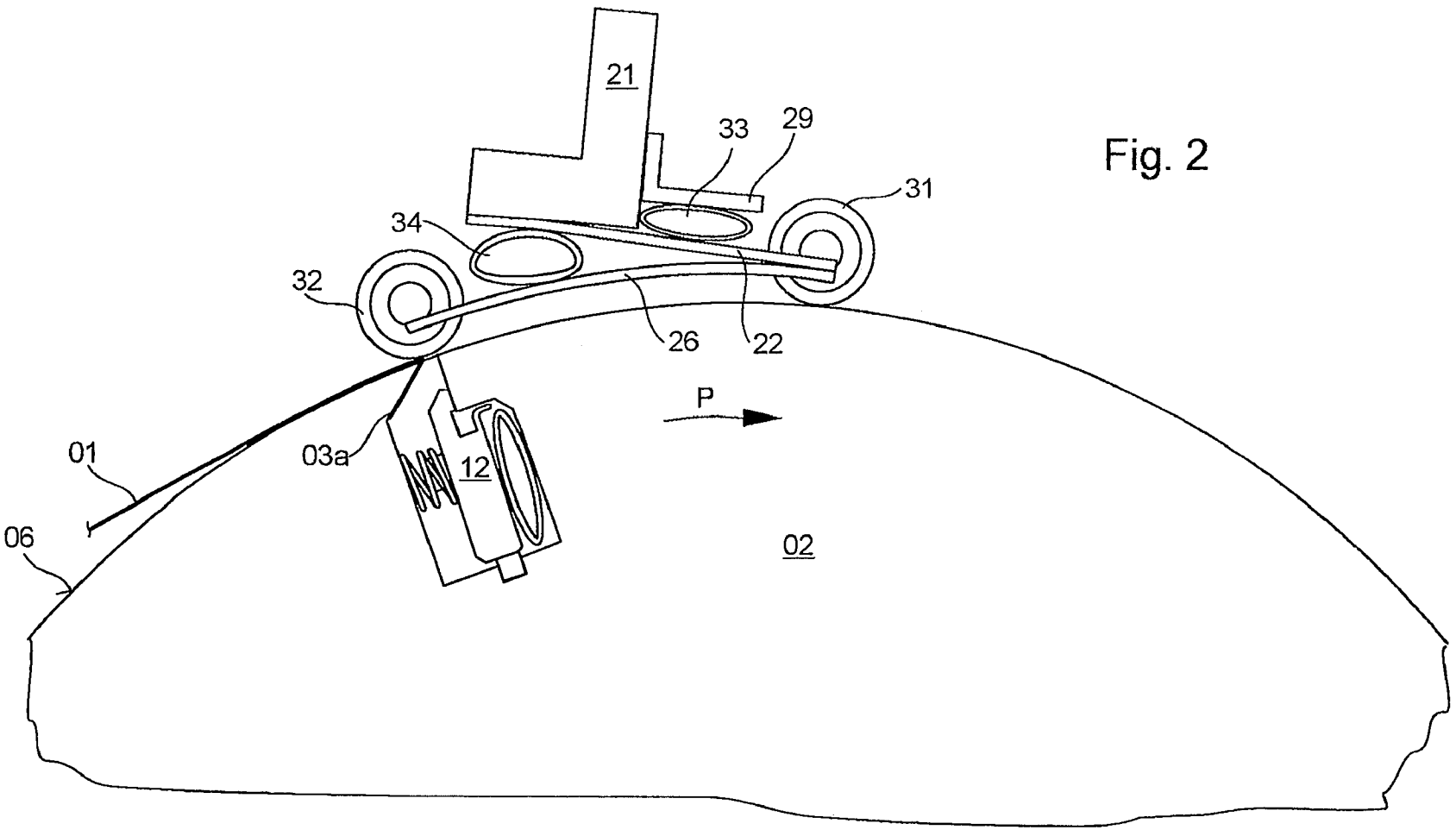

The second rolling element 32, which is located nearest the trailing end of the dressing 01, as seen in FIGS. 3 and 4, presses the suspension leg 03*b* into the opening 07, and the holding device 12 holding the trailing suspension leg 03*b* of the dressing 01 changes from its release position, shown in FIGS. 3 and 4, to its holding position, shown in FIGS. 1 and 2.

Thereafter the rolling elements 31, 32 are moved away from the cylinder 02. These rolling elements 31, 32 move away from the surface area 06 of cylinder 02 by deactivation of the actuating devices 33, 34. Once these actuating devices 33, 34 are no longer supplied with a fluid under pressure, they return to their deactivated states, as seen in FIG. 1. The rolling elements 31, 32 move away from cylinder 02 because of the resilient nature of their associated supports, 24, 26, respectively.

Figure 5:
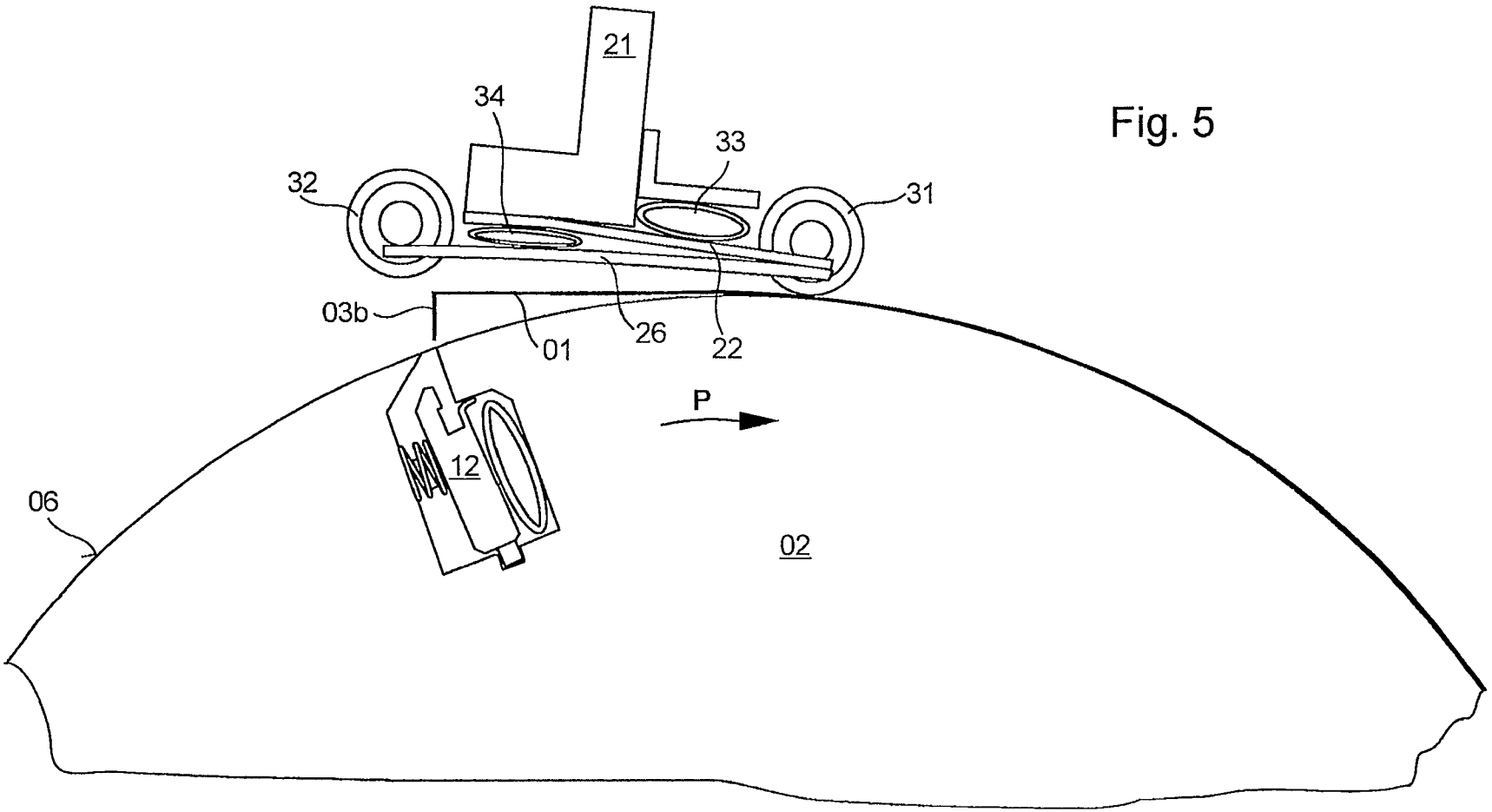
Figure 6:
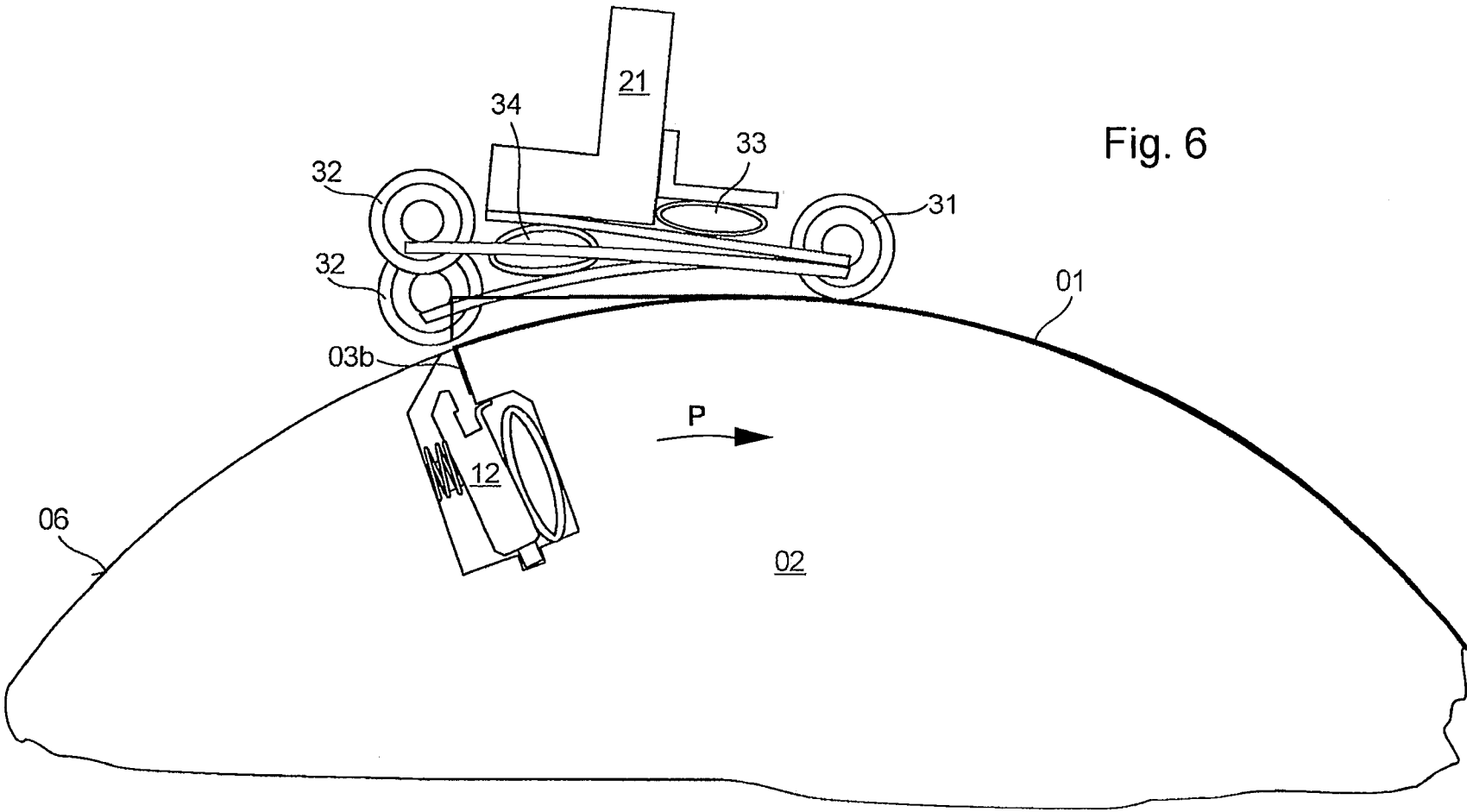
Figure 7:
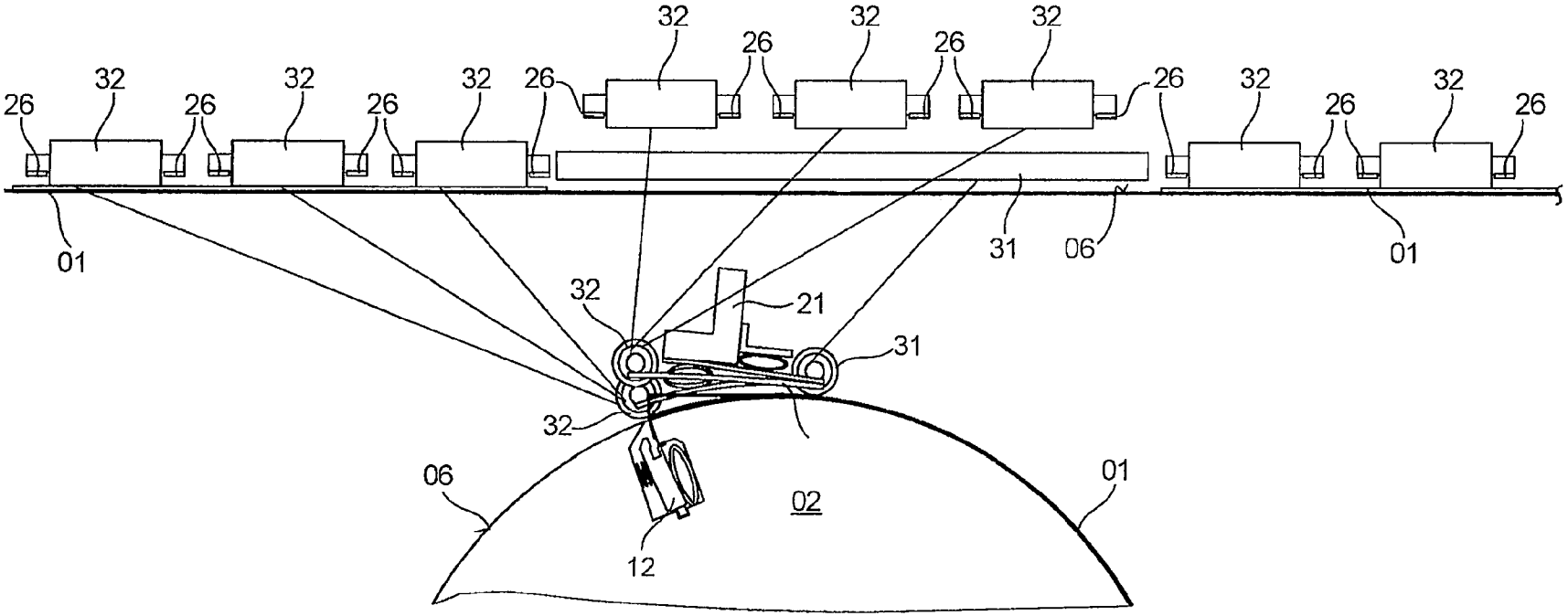
Figure 8:
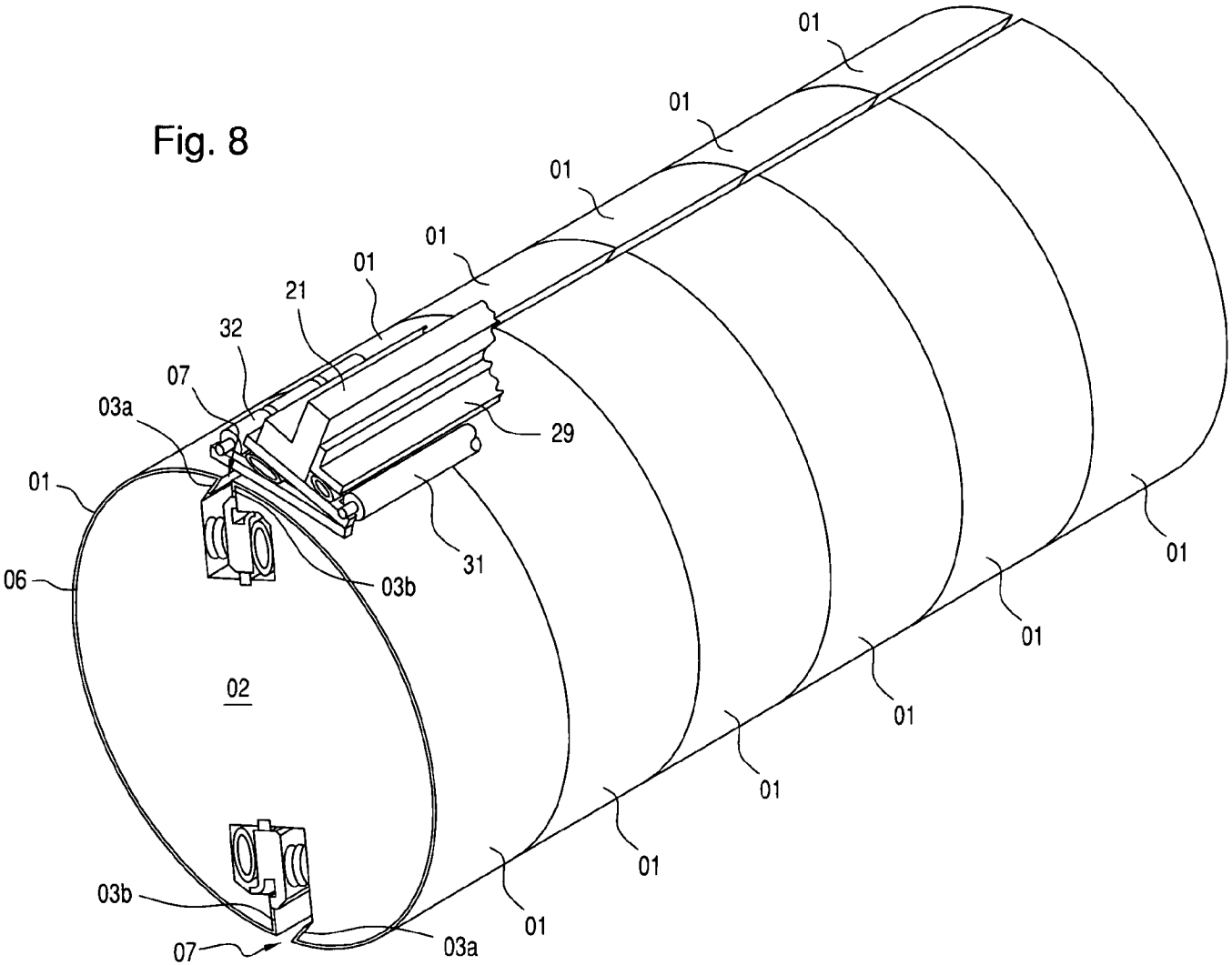

A method for releasing a flexible dressing 01 from a cylinder 02 of a printing press in accordance with the present invention, with the aid of rolling elements 31, 32 arranged on preferably elastically bendable supports 22, 26 is depicted in FIGS. 5 and 6. A first rolling element 31 is arranged on a first support 22, and a second rolling element 32 is arranged on a second support 26. Both of these first and second rolling elements 31, 32 are arranged spaced apart from each other in the circumferential direction of the cylinder 02. Several dressings 01 can be arranged side-by-side in the axial direction on the cylinder 02, as seen in FIG. 8. Each dressing 01 has suspension legs 03*a*, 03*b* beveled off its ends. The cylinder 02 has at least one opening 07 cut into its surface area 06 and this opening 07 has a first wall 04 and a second wall 17. The opening 07 leads to a channel 08 arranged extending axially in the cylinder 02 and with a holding device with a holding member 12 arranged in channel 08. The holding member 12 of the holding device has a holding position and a release position as its operating positions. This method is represented in FIGS. 5, 6 and 7 and is distinguished by the following method steps:

The rolling elements 31, 32 are each placed against one or against several dressings 01 resting on the surface area 06 of the cylinder 02.

The cylinder 02 is rotated until the second rolling element 32, arranged on the second support 26, rests against the suspension leg 03*b* of the trailing end of a dressing 01 to be removed. This is shown in FIG. 4.

The second rolling element 32 resting against the suspension leg 03*b* of the trailing end of the dressing 01 to be removed is now moved away from the cylinder 02 by deactuation of its actuating device 34, and the holding member 12 changes into its release position, preferably by pivoting. This is shown in FIG. 5. The suspension leg 03*b* at the trailing end of a dressing 01 to be removed from the cylinder 02 automatically springs out of the opening 07 because of its internal tension. The suspension legs 03*b* at the trailing ends of further dressings 01, which are also resting on the cylinder 02, remain pressed on to the cylinder surface 06 by the other second rolling elements 32 pressing them against the second wall 17 of the opening 07. These other second rolling elements 32 are not moved by the deactuation of the actuating device 34 associated with the second rolling element 32 moved away from its particular dressing trailing suspension leg 03*b*.

Thereafter, the holding member 12 of the holding device preferably changes back into its holding position, and the cylinder 02 is rotated counter to its production direction P until the suspension leg 03*a* at the leading end of the dressing 01 to be removed can be unhinged from the first wall 04 of the opening 07 and therefore can be removed from the cylinder 02.

A method for releasing a flexible dressing 01 from a cylinder 02 of a printing press with the aid of rolling elements 31, 32 arranged on preferably elastically bendable supports 22, 26, in which a first rolling element 31 is arranged on a first support 22, and a second rolling element 32 is arranged on a second support 26, in which both rolling elements 31 are arranged spaced apart in the circumferential direction of the cylinder 02, in which several dressings 01 can be arranged side-by-side, preferably in the axial direction, on the cylinder 02, in which each dressing 01 has suspension legs 03*a*, 03*b* beveled off its ends, in which the cylinder 02 has at least one opening 07 cut into its surface area 06 and the opening 07 has a first wall 04 and a second wall 17, in which the opening 07 leads to a channel 08 arranged in the cylinder 02 with a holding device with a holding member 12 arranged therein, and in which the holding member 12 of the holding device has a holding position and a release position as its operating positions, can also be distinguished by the following method steps:

The first and second rolling elements 31, 32 have been moved away from all dressings 01 resting on the surface area of the cylinder 02.

The cylinder 02 rotates until the second rolling elements 32 arranged on the second support 26 are located above the suspension legs 03*b* at the trailing ends of the dressings 01. These second rolling elements 32 are thus out of contact with the suspension legs 03*b*, but are still in their near vicinity.

All of the first rolling elements 31 arranged on the first support 22 are then placed against the cylinder 02, by which pressure, the dressings 01 are pressed against the surface area 06 of the cylinder 02 at a distance from their trailing ends corresponding to the distance between the first rolling element 31 arranged on the first support 22 and the second rolling element 32 arranged on the second support 26.

The holding member 12 of the holding device changes into its release position, preferably by pivoting. The suspension legs 03*b* at the trailing ends of all dressings 01 automatically spring out of the opening 07 because of their internal tension. This is depicted in FIG. 5.

Except for their trailing ends, the dressings 01 remain fixed on the surface area 06 of the cylinder 02 because of the pressure exerted by the first rolling elements 31 placed against the cylinder 02.

Except for those second rolling elements 32 located at the trailing end of a dressing 01 to be removed, now all of the second rolling elements 32 arranged on the second support 26 are placed against the cylinder 02. The suspension legs 03*b* at the trailing ends of all of the dressings 01 resting on the cylinder 02, with the exception of the suspension leg 03*b* of the dressing 01 to be removed, are again placed against the second wall 17 of the opening 07 by the second rolling elements 32 pressing them against opening second wall 17.

Thereafter, the holding member 12 of the holding device changes into its holding position, and all of the first and second rolling elements 31, 32 are moved away from the cylinder 02.

The cylinder 02 now rotates counter to its production direction P until the suspension leg 03*a* at the leading end of the dressing 01 to be removed can be unhinged from the first wall 04 of the opening 07, and thus can be removed from the cylinder 02.

FIG. 7 shows the assignment of spaced ones of a plurality of second rolling elements 32, arranged on several second supports 26, to several dressings 01 applied side-by-side to a cylinder 02 in the course of the removal of one of these dressings 01. In the example represented in FIG. 7, three such second rolling elements 32 are assigned to each dressing 01. These second rolling elements 32 for each dressing 01 can be placed against the cylinder 02, or can be moved away from the cylinder 02 independently of the remaining first and second rolling elements 31, 32, while adjoining dressings 01, for example, are maintained pressed against the surface area 06 of the cylinder 02 by those remaining first and second rolling elements 31, 32. Here, the first rolling element 31 is a continuous roller 31, while the second rolling elements 32 each consist of several individual rollers 32. The first and second rolling elements 31, 32, respectively are arranged spaced apart from each other in the circumferential direction of the cylinder 02. The first roller 31, which forms the first rolling element 31, is in contact with all of the dressings 01 which rest side-by-side on the cylinder 02, while the trailing end of the dressing 01 to be removed is being loosened. With the previously described methods, the first and second rolling elements 31, 32, respectively are preferably placed against or are moved away from the cylinder 02 by pneumatically operable actuating devices 33, 34.

A further method for removing a flexible dressing 01 from a cylinder 02 of a printing press with the aid of rolling elements 31, 32, in which a first rolling element 31 is arranged on a first support 22, and a second rolling element 32 is arranged on a second support 26, in which both rolling elements 31 are arranged spaced apart in the circumferential direction of the cylinder 02, in which several dressings 01 can be arranged side-by-side, preferably in the axial direction, on the cylinder 02, in which each dressing 01 has suspension legs 03*a*, 03*b* beveled off its ends, in which the cylinder 02 has at least one opening 07 cut into its surface area 06, which opening 07 has a first wall 04 and a second wall 17, in which the opening 07 leads to a channel 08 arranged in the cylinder 02 with a holding device with a holding member 12 arranged in channel 08, in which the holding member 12 of the holding device has a holding position and a release position as its operating positions, can also be distinguished by the following method steps:

The first and second rolling elements 31, 32 are placed against all of the dressings 01 resting on the surface area 06 of the cylinder 02.

The cylinder 02 rotates until the second rolling element 32 arranged on the second support 26 is located above the opening 07 at the trailing end of a dressing 01 to be removed.

The holding member 12 of the holding device changes into its release position.

The second rolling element 32 arranged on the second support 26 is moved away from the cylinder 02 at the trailing end of a dressing 01 to be removed. The suspension leg 03*b* at the trailing end of the dressing 01 to be removed is released from the opening 07 because of its internal tension, while the dressing 01 itself remains fixed in place on the surface area 06 of the cylinder 02 because of the pressure of the first rolling element 31. The trailing end of the dressing 01 to be removed tries to assume a stretched-out length, wherein this end of the dressing 01 now remains in contact with the second rolling element 32 over a defined spring travel while springing out of the opening 07. Therefore, the end of the dressing 01 springing out of the opening 07 follows the second rolling element 32 as it is being lifted off the cylinder 02. The suspension legs 03*b* of the remaining dressings 01 remain in the opening 07, because the ends of these dressings 01 remain pressed against the surface area 06 of the cylinder 02 by the second rolling element 32 assigned to them. The length of a released end of a dressing 01 to be removed from the cylinder 02 is defined by the distance of the contact point of the first rolling element 31 from the opening 07.

The holding member 12 of the holding device changes into its holding position, and all of the first and second rolling elements 31, 32, or at least the first rolling element 31 in front in the production direction P, can be moved away from the cylinder 02. Thereafter, if required after a rotation of the cylinder 02 counter to its production direction, the dressing 01 to be released can be removed from the surface area 06 of the cylinder 02.

A method for bracing or tightening a flexible dressing 01 on a cylinder 02 of a printing press, with the aid of first and second rolling elements 31, 32, in which a first rolling element 31 and a second rolling element 32 are provided, and in which both rolling elements 31, 32 are arranged spaced apart from each other in the circumferential direction of the cylinder 02, and in which several dressings 01 are arranged side-by-side in the axial direction of cylinder 01, can also be distinguished in that the first and second rolling elements 31, 32 are individually or are in groups placed against the dressings 01 resting on the surface area 06 of the cylinder 02 or are moved away from the surface area 06 of cylinder 02.

While preferred embodiments of devices for the pressing of a dressing to a cylinder of a printing machine, and methods for tightening or slackening the dressing, in accordance with the present invention, have been set forth fully and completely above, it will be apparent to one of skill in the art that various changes in, for example, the overall sizes of the cylinders, the source of the pressure and fluid for the actuating devices, and the like could be made without departing from the true spirit and scope of the present invention which is accordingly to be limited only by the amended claims.

What is claimed is:

1. A device for changing a dressing on a cylinder of a printing press comprising:

a plurality of first pressing elements supported adjacent the cylinder and spaced apart in an axial direction of the cylinder;

a plurality of second pressing elements supported adjacent the cylinder and spaced apart in said axial direction of the cylinder, said first and second pressing elements being spaced from each other in a circumferential direction of the cylinder, said first pressing elements leading and said second pressing elements trailing, in a production direction of rotation of the cylinder, on which several dressings are positioned side-by-side in said axial direction of the cylinder; and means for moving at least a partial number of said first pressing elements and at least a partial number of said second pressing elements against and away from at least one of the dressings on the cylinder independently of remaining ones of said plurality of first and second pressing elements.

2. The device of claim 1 wherein in a first operating position all of said first pressing elements and said partial number of said second pressing elements are placed against said dressings on said cylinder.

3. The device of claim 1 wherein at least one of said first pressing elements and at least one of said second pressing elements is assigned to each one of said several dressings positioned on the cylinder.

4. The device of claim 1 further including pneumatically operable actuating elements cooperating with said first and second pressing elements and adapted for selectively moving said first and second pressing elements against and away from the cylinder.

5. The device of claim 1 wherein each said first and second pressing element is a rolling element.

6. The device of claim 5 wherein each said rolling element is a roller.

7. The device of claim 5 further including at least one first support for said first pressing elements, said first pressing elements including an axially extending roller on said first support, and a plurality of second supports, each having at least one of said second pressing elements, said plurality of second supports being arranged on said first support.

8. A method for pressing a dressing on a cylinder of a printing press including:

providing at least one first pressing element spaced apart from and positioned adjacent a surface of said cylinder;

providing at least one second pressing element spaced apart from and positioned adjacent said surface of said cylinder;

spacing said first and second pressing elements apart from each other in a circumferential direction of said cylinder with said first pressing element leading, and with said second pressing element trailing, in a production direction of rotation of said cylinder;

providing suspension legs beveled off at leading and trailing ends of said dressing;

providing at least one axially extending, dressing suspension leg receiving opening in said surface of said cylinder;

inserting said leading one of said dressing suspension legs into said opening;

moving said at least one first pressing element and said at least one second pressing element into contact with said dressing only after inserting said leading one of said dressing suspension legs into said opening;

rotating said cylinder in said production direction; and using said second pressing element for pressing said trailing one of said dressing suspension legs into said opening.

9. The method of claim 8 further including providing said pressing elements as rolling elements.

10. The method of claim 9 further including providing said rolling element as a roller.

11. The method of claim 10 further including providing a first support, using said first support for supporting a roller forming said at least one first pressing element, providing a plurality of second supports connected to said first support, each of said plurality of second supports supporting at least one rolling element forming said at least one second pressing elements on each of said second supports.

12. The method of claim 8 further including moving both of said at least one first pressing element and said at least one second pressing element out of contact with said dressing after pressing said trailing one of said dressing suspension legs into said opening.

13. The method of claim 8 further including providing a holding means in said opening, supporting said holding means for movement between a holding position and a release position, and moving said holding means to said release position from said holding position before pressing said trailing one of said dressing suspension legs into said opening.

14. The method of claim 13 further including moving said holding means from said release position to said holding position after pressing said trailing one of said dressing suspension legs into said opening.

15. In combination, a device for changing a dressing on a cylinder of a printing press, and a cylinder comprising:

a cylinder having an axial direction and a circumferential direction;

a plurality of first pressing elements supported adjacent said cylinder and spaced apart in said axial direction of the cylinder;

a plurality of second pressing elements supported adjacent said cylinder and spaced apart in said axial direction of said cylinder, said first and second pressing elements being spaced from each other in said circumferential direction of said cylinder, said first pressing elements leading and said second pressing elements trailing, in a production direction of rotation of said cylinder, on which several dressings are positioned side-by-side in said axial direction of said cylinder; and means for moving at least a partial number of said first pressing elements and at least a partial number of said second pressing elements against and away from at least one of the dressings on said cylinder independently of remaining ones of said plurality of first and second pressing elements.

16. The combination of claim 15 further including six dressings arranged side-by-side in said axial direction of said cylinder.

17. The combination of claim 16 further including two dressings arranged in said circumferential direction of said cylinder.

* * * * *